US005669074A

United States Patent [19]

Newman, Jr.

[11] Patent Number: 5,669,074

[45] Date of Patent: Sep. 23, 1997

[54] REMOVABLE NECK SUNSHADE FOR A CAP

[76] Inventor: Harry L. Newman, Jr., 3500 Mystic Pointe Dr., No. 1206, North Miami Beach, Fla. 33180

[21] Appl. No.: 513,357

[22] Filed: Aug. 10, 1995

[51] Int. Cl.[6] ..... A42B 1/06

[52] U.S. Cl. ..... 2/172; 2/175.3; 2/209.13

[58] Field of Search ..... 2/172, 175.3, 175.6, 2/209.13, 206, 207

[56] References Cited

U.S. PATENT DOCUMENTS

| | | | |
|---|---|---|---|
| 1,481,541 | 1/1924 | Douglas | 2/207 |
| 4,180,868 | 1/1980 | Snow | 2/172 |
| 4,526,420 | 7/1985 | Kawamura et al. | 297/218.1 |
| 5,046,195 | 9/1991 | Koritan | 2/172 |
| 5,448,778 | 9/1995 | Phillips | 2/172 |

*Primary Examiner*—Diana Biefeld

*Attorney, Agent, or Firm*—Malin, Haley, DiMaggio & Crosby, PA

[57] ABSTRACT

A neck sunshade which can be readily installed or removed from a conventional baseball cap, having a fabric body to prevent ultraviolet rays from reaching the neck of the user and a stretchable elastic ringlet attached thereto for exterior mounting on the exterior surface of said baseball cap. The device is held firmly in place by the elastic ringlet which can contact the front visor of said baseball cap and fit snugly but comfortably around the remaining portion, holding the fabric shield in place over the back neck of the user.

4 Claims, 2 Drawing Sheets

REMOVABLE NECK SUNSHADE FOR A CAP

BACKGROUND OF THE INVENTION

1. Field of the Invention

This invention relates to sunshades adapted to protect the neck of the wearer, especially from harmful ultraviolet rays, particularly a neck sunshade that can be easily attached or removed from a baseball cap so that the wearer of the baseball cap can quickly position the neck sunshade or remove the neck sunshade as desired.

2. Description of the Prior Art

In recent years, there has been a dramatic increase in reported cases of skin cancer. One of the causes of the rise in the number of skin cancers is the increased exposure to direct rays of the sun. Outdoor sporting events, beaches, and marine activities have attracted people to spend long periods of time exposed to sunlight.

Many people wear caps to shield the top of their head from the sun that contain a visor or cap bill, commonly referred to as a baseball cap. While these baseball caps do provide some sun protection in shielding sunlight, the back of the neck of the wearer is exposed to ultraviolet rays of the sun. Often, the wearer of a baseball cap will not notice how much sun exposure there is on the back of the neck.

The use of neck sunshades is known in the prior art. U.S. Pat. No. 5,201,077, issued Apr. 13, 1993 to Dondlinger, shows a neck sunshade that is affixed to the inside portion of the cap within the sweatband. While such an attachment, typically with a fabric fasteners such as Velcro loop and hook strips will hold the sunshade in place, it offers the disadvantages of causing the sunshade to be mounted inside the cap against the head and, even more importantly, is cumbersome to operate for attachment and disengagement of the sunshade from the cap.

It is desirable, both for convenience and to save on cost, to have an attachable neck sunshade that does not have to be integrally manufactured with the cap itself. This allows the wearer of the cap the flexibility of selecting whether or not to use the neck sunshade.

The present invention provides for a neck sunshade that can be easily and quickly attached or removed from a baseball cap by the wearer, while at the same time the invention is securely mounted about the cap in a comfortable fashion, such that it cannot be removed accidentally by head movement of the wearer or wind. The present invention includes a fabric sunshade, sized and shaped to appropriately cover portions of the rear neck of the wearer and includes an elastic ringlet attached to an upper edge of the sunshade body that allows it to be quickly mounted right over the cap while it is on the wearer's head.

SUMMARY OF THE INVENTION

A neck sunshade that is readily mounted or removed from the outside perimeter of a cap, such as a baseball cap, to reduce or eliminate rays of the sun from striking the neck area and lower head area of the user.

The neck sunshade includes a fabric body or cloth body that is capable of blocking solar rays, including ultraviolet rays, that is substantially rectangular in shape, and includes an elastic ringlet attached along the top edge of the sunshade fabric body, the elastic ringlet being sized in diameter to fit snugly about the outside of a cap of a predetermined size.

The sunshade fabric body is sized in length to substantially fit about one-half of the circumference of a conventional baseball cap, representing the rear hemispherical head portion of the user from side-to-side.

The length of the cloth or fabric sunshade body can be such as to reach from the cap band area downwardly to approximately the shoulder length of the wearer to provide complete protection of the rear neck area of the user.

As described above, the sunshade body could be rectangular or could be somewhat circular at the bottom edge as it drapes around the lower neck and upper back portion of the user.

The uppermost edge of the sunshade fabric body has an overlap portion that is secured by threads and sewn along the entire top edge to form a channel or passage completely across the entire sunshade body top edge.

Attachment and mounting of the sunshade to the exterior circumference of a cap is accomplished by a vinyl or rubber tubular ringlet sized approximately to fit around the diameter of a baseball cap having a predetermined diameter size. In fact, the diameter of the ringlet may be approximately the same size as a conventionally picked size for an average person. The ringlet tubular body is resilient longitudinally and sufficiently elastic to stretch approximately twice its length or stretch in a two-to-one ratio. This permits a firm, yet comfortable, mounting around a cap body that has substantially the same diameter as the ringlet.

The ringlet itself is mounted and permanently attached to the sunshade fabric body through the top edge passage on the fabric body. Typically, the ringlet may be formed of a plastic tube approximately one foot in length and is heat welded at both ends to form a permanent ring. Other stretchable type ringlets could be utilized.

To install the sunshade, the user would have the user's cap in place, mounted on the user's head. The sunshade is then positioned in the rear neck area of the user and the ringlet stretched about over the exterior hemispherical shape of the cap so that it resides approximately at the hat band area circumferentially and abutting the top surface of the bill of the cap in the front.

While it is in place, the diameter of the ringlet is such that it is slightly stretched and tensioned to allow it to remain supportably about the cap exterior.

To remove the sunshade, the wearer need only grasp the ringlet on each side and lift upwardly away from the exterior cap body.

It is an object of this invention to provide an improved neck sunshade that can be mounted exteriorly on a baseball cap that can be easily installed or removed by the user.

It is another object of this invention to provide a removable sunshade to protect the neck of the wearer while wearing a hat from deleterious rays of the sun, such as ultraviolet rays.

And yet another object of this invention is to provide an improved sunshade for the neck of a wearer while the wearer is wearing a hat that can be comfortably mounted from the exterior of the hat.

In accordance with these and other objects which will become apparent hereinafter, the instant invention will now be described with particular reference to the accompanying drawings.

DESCRIPTION OF THE PREFERRED EMBODIMENTS

Figure 1:
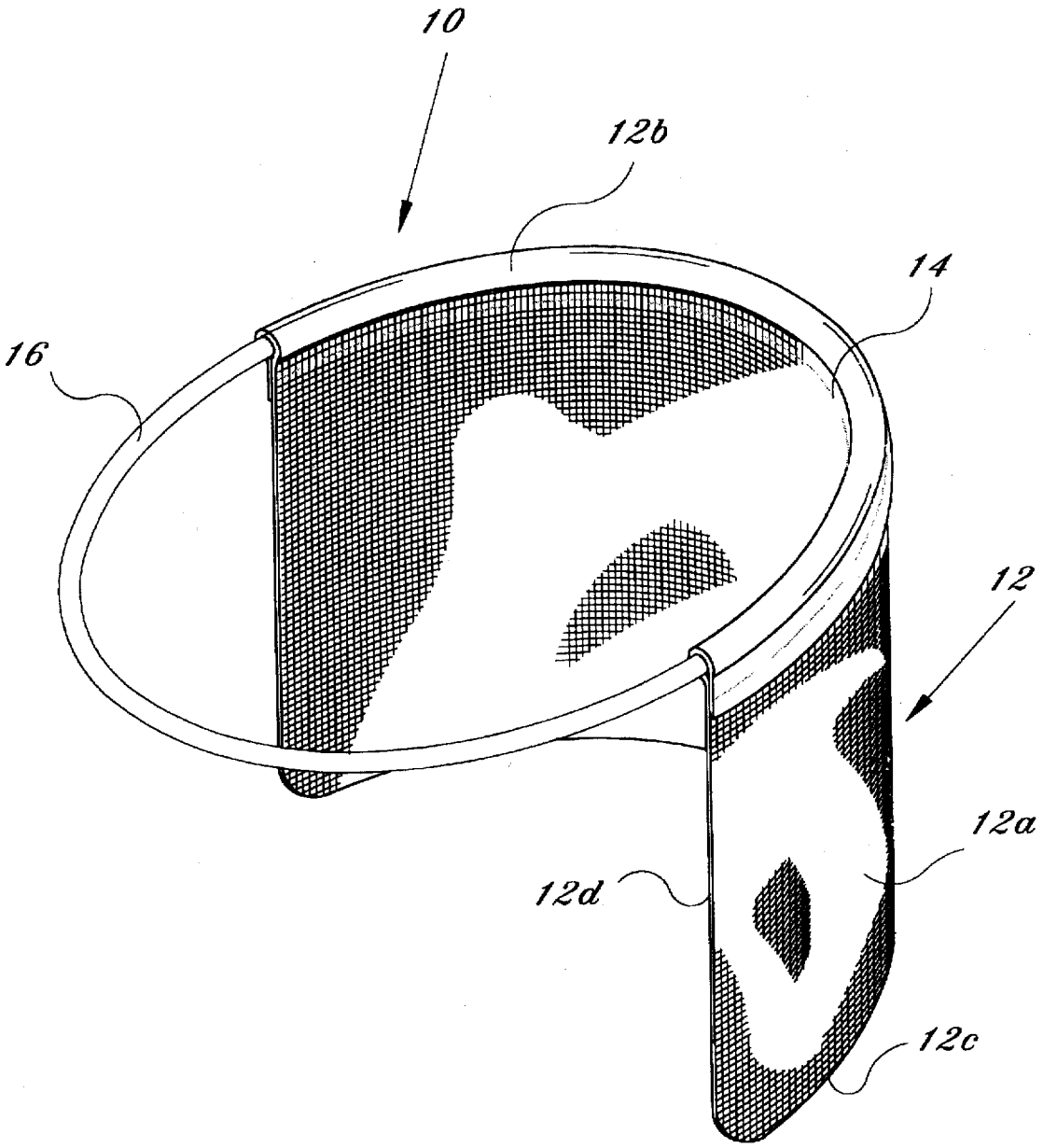
FIG. 1 shows a perspective view of the present invention.

Referring now to the drawings, and in particular FIG. 1, the present invention is shown generally at 10, comprised of a fabric body sunshield 12 having a substantially rectangular body portion 12*a* that is sized in length to fit approximately half the circumference of an average person's cap size.

The top edge of the fabric body 12*a* includes a rolled over, substantially circular passage formed by top edge 12*b* that allows the top edge to be placed back over itself and sewn by thread 14 forming a firm, closed passage throughout the length of top edge portion 12*b*.

The bottom edge 12*c* is disposed along the bottom of fabric body 12*a* and may be straight or slightly circular to accommodate contact with the upper back portion of the user. Two side edges 12*d* are disposed vertically from the top edge channel 12*b*. The vertical length of side edges 12*d* are such to allow complete coverage from the approximate position of a hat band downwardly to the shoulder area of the user to completely protect the rear neck portion of the user from the sun's rays. Typically, the lower bottom edge 12*c* would contact the upper back portion of the user below the shoulder blades.

The sunshade 10 includes an elastic ringlet 16 that is a closed ring or loop made of preferably a tubular vinyl product that can be stretched without breaking to approximately twice its existing length along each segment. In other words, there is a stretch ratio of approximately two to one for the ringlet 16. The ringlet is manufactured so that it is permanently installed within the circular channel in the sunshade 12 formed by the upper edge of the sunshade fabric body 12*b*. The diameter of the ringlet 16 is sized to be that of approximately the size of the exterior diameter of a conventional baseball cap of a predetermined size. In fact, the ringlet 16 may be slightly smaller in diameter than the exterior of the predetermined baseball cap diameter to allow some tension when it is installed on the exterior portion of the baseball cap. Since ringlet 16 is stretchable or flexible along its longitudinal length, it can accommodate larger cap sizes comfortably for the wearer.

Figure 2:
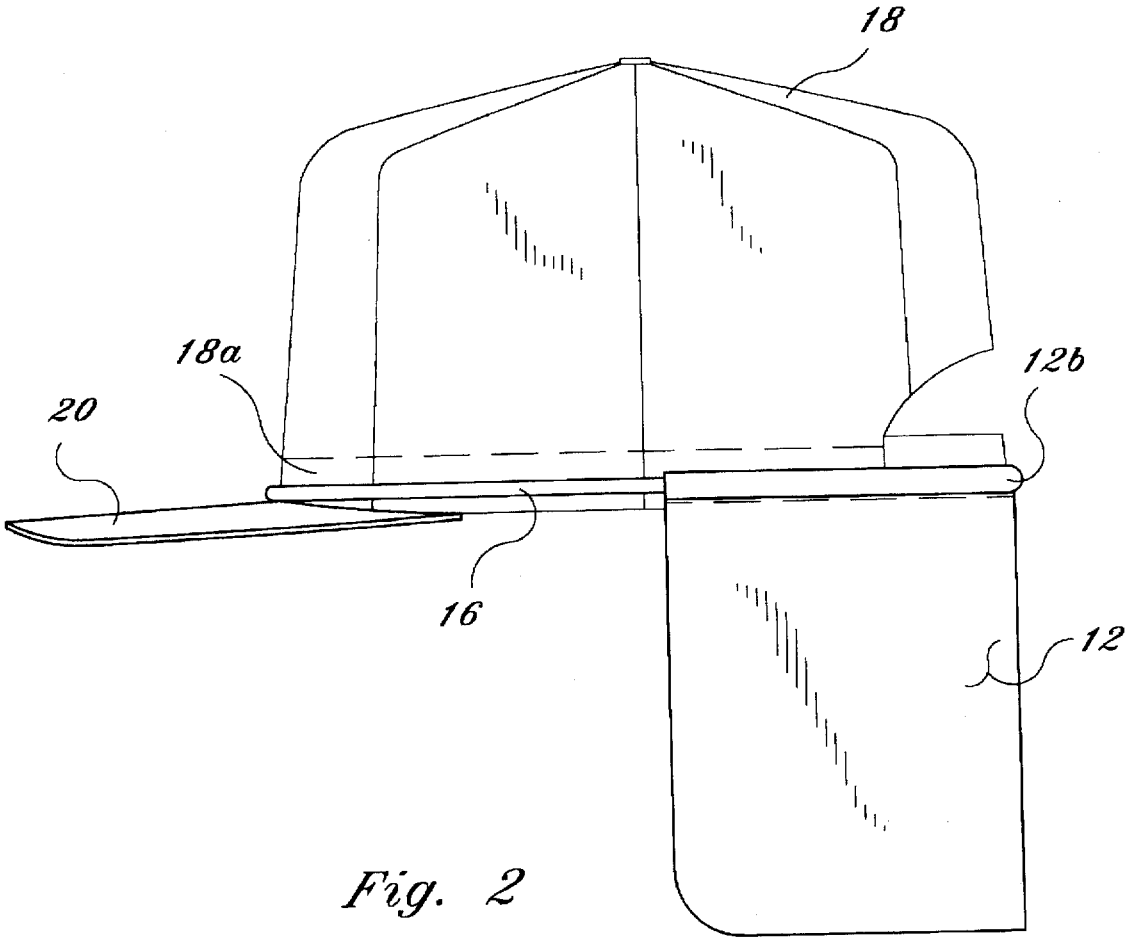
FIG. 2 shows a side elevational view of the present invention as it would be attached to a baseball cap.

FIG. 2 shows a side view of a baseball cap having the cap portion 18 and a bill 20 with the present invention having fabric sunshade body 12 mounted on the rear portion of the cap 18. The stretchable ringlet 16 contacts the bill on the front portion of the hat so that it cannot drop below that and contacts the side portions of the hat near the area of the hat band on the exterior of the cap 18.

Figure 3:
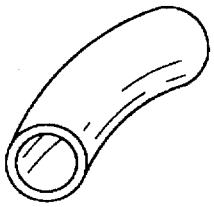
FIG. 3 shows a perspective view, partially cut away, of a portion or segment of the elastic ringlet used in the invention.

FIG. 3 shows a segment of a desired ringlet which could be a tubular vinyl product. Typically, the length of the tube before it is formed into a ring would be approximately one foot or at least the circumference that would fit snugly around the exterior of the cap. The two ends of the tube are heat sealed together to form a permanent ring or ringlet.

The fabric body 12 can be made of conventional cloth or synthetic materials that would be suitable for blocking out rays of the sun, particularly ultraviolet rays. In the preferred embodiment, the sunshade 12 fabric is made of a light cotton. The length across the top band is approximately 15 inches, while the width is approximately 11 inches of the fabric body. The length of the elastic ringlet may be approximately 24 inches. This allows the device to fit comfortably on a standard size 7 hat and to expand to larger hat sizes without discomfort to the user.

To use the device, returning to FIG. 2, as shown installed, the user would have the cap on and merely place the elastic ringlet and the sunscreen over the exterior top of the cap and pull it down into position. The elastic band touches the bill in front and the sunshade is comfortably over the neck area of the user, while the band area and upper edge 12*b* are approximately near the base of the hat band of the cap 18. The cap sweatband 18*a* is inside the cap around the bottom edge of the cap 18.

To remove the sunshade, the user merely grasps the elastic band and sunshade on each side and raises it above the cap.

Although the elastic ringlet has been shown as tubular vinyl or similar material, it is believed that a stretchable ring of any desirable shape or fabric could be employed.

The invention is easily and quickly installed or removed from the cap of a wearer. The invention will comfortably the wearer comfortably against protect the rear neck portion of the wearer from deleterious rays of the sun, such as ultraviolet rays, while remaining comfortably in place through various activities without the possibility of the sunshade becoming disengaged from the exterior portion of the cap. The sunshade can be readily stored for convenience since it is made of a flexible material.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A sunshade and baseball cap combination, comprising:

a fabric body, substantially rectangular in shape, having a length equal in distance to approximately one-half a diameter of an exterior of a baseball cap and sized in length to cover the neck of a wearer; and a stretchable ringlet having a diameter slightly less than the diameter of the exterior of said baseball cap, said stretchable ringlet being permanently connected to the sunshade body, said sunshade body having an upper edge portion, said ringlet being attached to said upper edge of said sunshade fabric body, said stretchable ringlet is made from a tube, said tube constructed of a stretchable vinyl having a stretch ratio of two to one, such that in an unstretched state, the length of the tubular segment can be stretched to almost twice its length without breaking whereby said sunshade can be readily mounted over the exterior of said baseball cap such that said ringlet is disposed along a top surface of the bill portion of the cap in a front portion and the sunshade is disposed along a rear portion of the cap, protecting the rear neck of a wearer when in place.

2. A sunshade and baseball cap combination in claim 1, wherein said fabric body is comprised of a lightweight cotton material.

3. A sunshade and baseball cap combination as in claim 1, wherein said sunshade body has a top edge that overlaps itself, forming a passage and a thread attaching the top edge of said sunshade body to itself by sewing, forming a passage, said elastic ringlet being attached through said sunshade body top edge passage.

4. A sunshade and baseball cap combination, comprising:

a fabric sunscreen body which acts as a barrier to ultraviolet rays from the sun, substantially rectangular in shape, having a length that will fit approximately half of an exterior peripheral circumference of a baseball cap and a width sized to cover the neck of a wearer; and a stretchable elastic ring affixed to said fabric body, said ring diameter being sized to be slightly smaller than a diameter of said baseball cap, allowing the ring to be firmly attached around the exterior peripheral circumference of said baseball cap, said elastic ring is made from a tube, said tube constructed of a stretchable vinyl having a stretch ratio of two to one, such that in an unstretched state, the length of the tubular segment can be stretched to almost twice its length without breaking, whereby said fabric body can be easily mounted or removed from the exterior portion supported over said cap.

* * * * *